United States Patent [19]

Kin

[11] 4,214,333

[45] Jul. 29, 1980

[54] APPARATUS FOR TRIMMING BOLTHEADS OR THE LIKE

[75] Inventor: Nelson I. Kin, Tiffin, Ohio

[73] Assignee: The National Machinery Company, Tiffin, Ohio

[21] Appl. No.: 959,080

[22] Filed: Nov. 9, 1978

[51] Int. Cl.[2] ..... B21K 1/50

[52] U.S. Cl. ..... 10/20; 10/24; 72/325

[58] Field of Search ..... 10/19, 20, 23, 24; 72/325, 326; 267/119, 130

[56] References Cited

U.S. PATENT DOCUMENTS

| | | | |
|---|---|---|---|
| 1,294,987 | 2/1919 | Wilcox | 10/20 |
| 3,740,997 | 6/1973 | Blake et al. | 267/119 |

*Primary Examiner*—Lowell A. Larson

*Attorney, Agent, or Firm*—Pearne, Gordon, Sessions

[57] ABSTRACT

A trim die system for trimming bolt heads or the like is disclosed in which a trim die is formed with a polygonal opening extending therethrough and providing cutting edges at the forward end thereof. The cutting edges are formed in the shallow recess in the forward end of the die, and are spaced back from a land which engages the tool to prevent contact between the cutting edges and the tool when operating without blanks. The land protects the cutting edges against damage and the structure provides increased die life. The tool is mounted for limited sliding movement and is biased toward an extended position. When the die first engages a blank supported by the tool, the tool moves back against the biasing force to reduce the initial impact on the cutting edges of the tool.

23 Claims, 7 Drawing Figures

APPARATUS FOR TRIMMING BOLTHEADS OR THE LIKE

BACKGROUND OF THE INVENTION

This invention relates generally to the manufacture of bolts, and more particularly to a novel and improved trim die system for shearing a headed bolt blank to provide the head with a polygonal shape such as a hexagonal shape.

PRIOR ART

It is well known to form hexagonal bolt blanks by trimming the head of a blank in the last station of a progressive header to provide the blank with a hexagonal shape. U.S. Pat. No. 2,087,087 illustrates such a trimming system.

Over the years the operating speed of machines for producing bolts having trimmed heads has increased substantially. When using conventional trim dies, even when they are formed of expensive, very high quality tool steels, experience has indicated that the dies usually have to be replaced after the manufacture of 12,000 to 15,000 parts. With the present high speed machines, some of which presently produce 300 bolts per minute, such a number of bolt blanks or parts are produced in a very short period of time, with the result that the changing of such tools must occur at very short intervals. This often causes very significant amounts of lost machine time, with the consequence that the production of the machine is materially reduced. Further, the cost of replacement tools is significant, since it is necessary to use high quality and expensive tool steel to obtain such tool life.

SUMMARY OF THE INVENTION

In accordance with the present invention, a trim die system is provided which has substantially longer life, even when the dies are formed of conventional and relatively low cost tool steels. In tests of the dies in accordance with the present invention, the tool life is increased, in a comparable operation, from the former tool life of 12,000 to 15,000 blanks or parts to a tool life of about 65,000 to 90,000 blanks or parts. This increased life was achieved even though the tool steel used to form the test dies in accordance with this invention was of substantially lower quality and cost.

In accordance with the present invention, the tool and die are structured so that the cutting edge of the die does not contact the tool surfaces, even when the machine is operated without blanks. Further, the tool and die are supported to reduce the initial impact force of the cutting edges.

In the illustrated embodiment, the cutting edges of the trim die are spaced back from the forward face of the die so that they do not contact the associated tool even when the machine is run without blanks. Further, the tool, which is mounted on the die breast or stationary portion of the machine, is slidable with respect to the die breast to reduce the impact loading on the cutting edges of the trim die when the blank is first engaged.

DETAILED DESCRIPTION OF THE DRAWINGS

Figure 1:
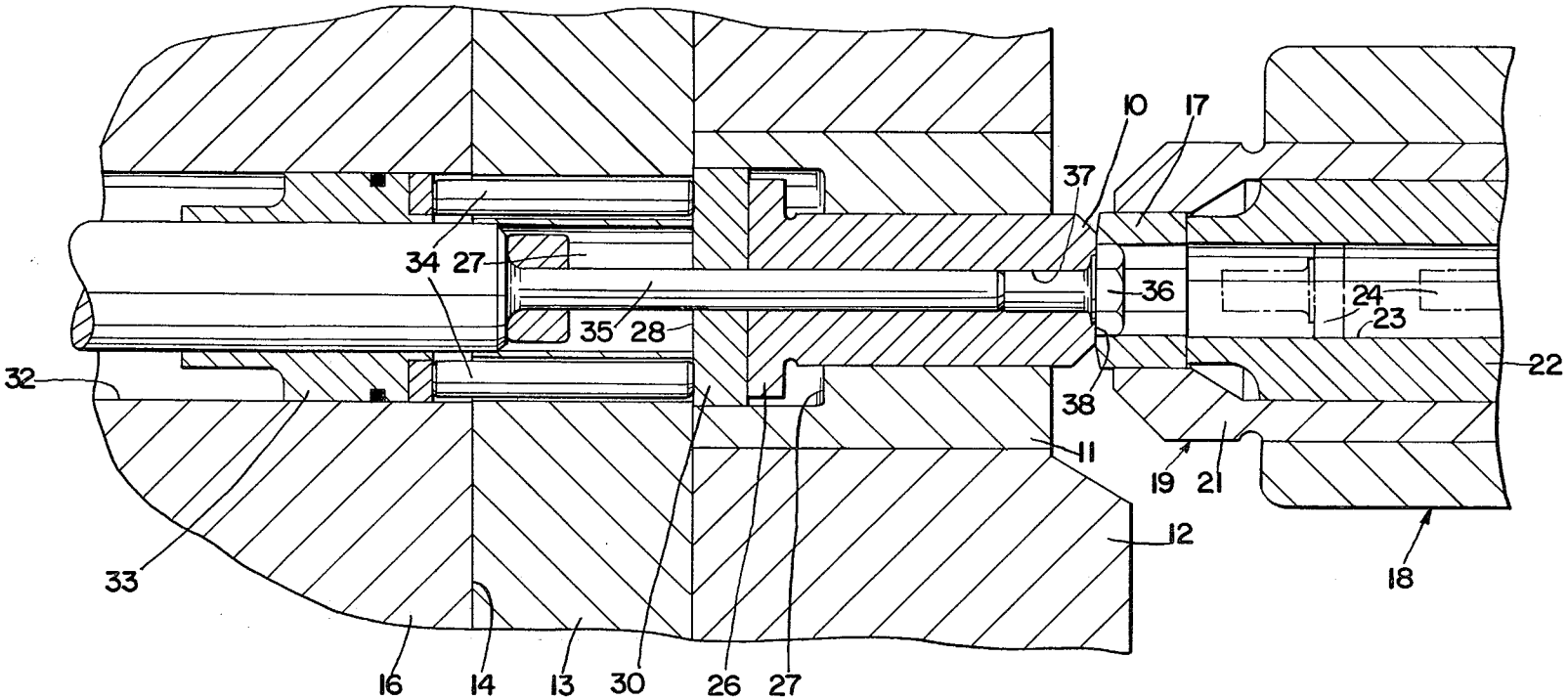
FIG. 1 is a longitudinal section through the trim station and illustrates the trim die system in accordance with the present invention.
Figure 2A:
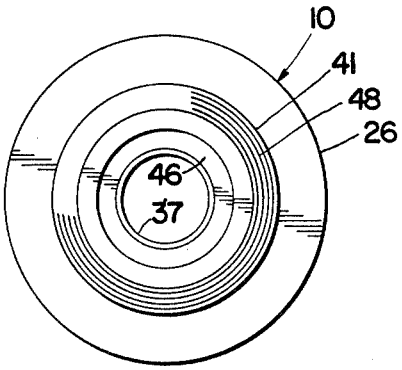
FIG. 2*a* is an enlarged end view of the tool which supports the blank during trimming.
Figure 2B:
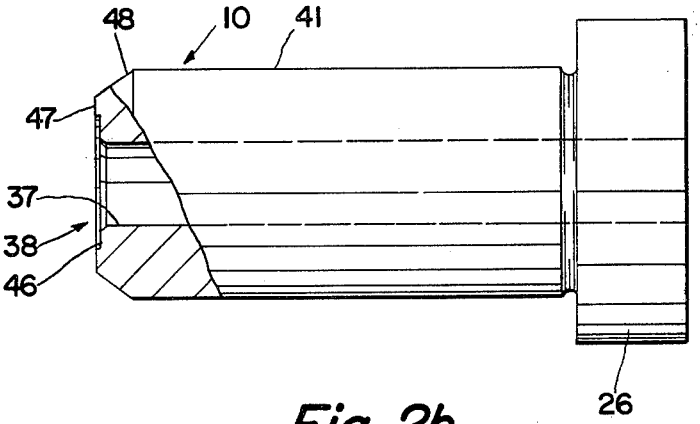
FIG. 2*b* is a side elevation, partially in section, of the tool illustrated in FIG. 2*a*.

In a typical bolt forming operation, wire feeds into a cutter of a progressive header which cuts the wire into blanks that are progressively formed to produce a shank for subsequent threading and a circular head for subsequent trimming to a hexagonal shape in the last station or trim station of the machine.

In a typical trim station, a stationary tool is mounted on the die breast of the machine, and cooperates with a trim die on the machine slide. The headed blank is positioned in the stationary tool, with the shank projecting into a central passage therein. The face of the tool is formed to mate with the underside of the head so as to support the projecting head of the blank during the shearing operation.

The conventional trim die is formed with a planar end face and a central polygonal passage which is hexagonal when forming hexagonal headed bolts. In such conventional trim die, the cutting edge of the trim die is located at the intersection of the forward die face and the polygonal passage.

As the trim die is carried forward by the slide, it engages the circular head of the blank held by the tool, and shears away the excess material to produce the required polygonal head shape.

In practice, the tool and die are adjusted so that when the slide reaches the forward dead center position, the face of the die is spaced slightly from the face of the tool so that the cutting edges do not actually contact the tool. A thin layer of head material extends radially between the two end faces and remains joined with the head. After the slide reaches the forward dead center position, an ejector pin extending into the stationary tool is operated to push the blank from the tool into the trim die to shear such thin layer from the head and to move the trimmed blank into a passage aligned with the polygonal opening in the trim die. The trim blanks then move along such passage and to the threader portion of the machine. As the slide moves back from the forward dead center position, the scrap trimmed from the head drops clear of the trim station.

The relatively low trim die life achieved with the prior art is believed to occur for two reasons. When the machine is operating without a blank, the trim die actually engages the face of the tool. Such engagement occurs when a blank is not present because of the various clearances in the machine bearings and the like. In any event, in a conventional trim system, the cutting edges themselves engage the stationary tool when the machine is operated without a blank and such engagement between the two hardened surfaces causes damage to the cutting edges of the die. In time, the damage occurring in such manner necessitates replacement of the die. Avoidance of operation without blanks being worked is essentially impossible because the machine operator must clear the machine before shutting it down. Further operation without blanks often occurs during the changing of the rolls of wire stock, and whenever the forming operation must be interrupted for any other reason.

It is further believed that the high speed operation of the newer machines produces very high impact loads when the trim die first engages the blank, which also contributes to reduced die life.

In accordance with the illustrated embodiment of the present invention, a system is provided to prevent contact between the cutting edges of the trim die and the cooperating tool even when the machine is operating without blanks. Further in accordance with the illustrated embodiment, the tool mounted on the die breast is mounted for limited sliding movement to reduce the impact loading on the cutting edge at the instant the cutting edge engages the head of the blank to commence the shearing operation.

Referring to the drawings, FIG. 1 illustrates the trim station of a typical progressive header in which a system in accordance with the present invention is provided. As illustrated, a tool 10 is mounted within a tool support 11, which is in turn mounted on the die breast 12 of the machine. Positioned behind the die breast 12 is a backup plate 13 which is seated against a face 14 on the frame 16 of the machine.

A trim die 17 is supported on the slide assembly 18 by a die holder assembly 19, which consists of a die support ring 21 and a tubular backup member 22 which engages the rearward face of the trim die 17 and provides a central passage 23 along which trimmed blanks 24 move from the trim station. The die holder is provided with a conventional clamping system (not illustrated) which releasably grips the die to secure it in place.

In FIG. 1, the slide 18 is illustrated in its forward dead center position in which the forward face of the trim die 17 is substantially adjacent to the forward face of the tool 10. As mentioned above, the machine is normally adjusted so that when a blank is being trimmed, the trim die 17 does not actually engage the tool 10, but is spaced therefrom by a few thousandths of an inch. However, in the drawings, such spacing and the sheared material are not illustrated in order to simplify the drawings.

The tool 10 is slidably mounted in the tool support 11 from a rearward position illustrated in FIG. 1 to a forward position in which a flange 26 engages a radial wall 27 in the tool support 11. A filler plate 30 engages the rearward face 28 of the tool 10 and limits its rearward travel by engaging the backup plate 13. Thetool 10 is moved forward from the rearward position illustrated when the slide carries the trim die 17 back from the forward dead center position by a pneumatic system, including a piston 33 which is slidably mounted in a bore 32 in the frame 16. The bore 32 rearwardly of the piston 33 is pressurized to produce a force on such piston, urging it to the right as viewed in FIG. 1. Positioned between the forward end of the piston 31 and the rearward side of the filler plate 30 are a plurality of pins 34 which transmit the force from the piston to the filler plate and, in turn, to the tool. With this structure, the tool 10 is pneumatically held in its forward position except when it is pressed back to the rearward position, illustrated, by the forces applied to the tool through the blank by the trim die 17. An ejector pin 35 is powered by a drive system (not illustrated) in timed relation to the operation of the machine, and operates to engage the end of a blank 36 located in the tool 10 and, after the slide 18 carries the trim die 17 to the forward dead center position, operates to push the blank out of the tool 10 and into the passage 23, completing the trimming operation as described above. After the blank is ejected into the passage 23, the slide 18 moves back from the tool, carrying with it the blank contained in the passage 23. This allows the tool 10 to move to its extended position while a subsequent blank is transferred by automatic transfer fingers (not illustrated) for a subsequent operation.

Preferably, a latching mechanism, as illustrated in the U.S. Pat. No 2,087,087 cited above, is provided within the passageway 23 to prevent the blanks 24 from falling out of the passageway 23 as the slide retracts. Such patent is incorporated herein by reference.

When a subsequent untrimmed blank is positioned in front of the extended tool 10 by the transfer mechanism, it is engaged by the trim die 17 and pushed into the bore 37 in the tool 10 until the underside of the head of the blank engages the end face 38 of the tool 10. As the blank is pushed into the bore 37, the end of the blank engages the end of the ejector pin 35 and pushes it back toward its rearward position back from the face of the tool 10. Once the untrimmed blank is properly seated in the tool, the forces applied to the tool through the blank by the trim die 17 overcome the forces of the piston 33 and slide the tool 10 back to the rearward position illustrated. During this preliminary movement of the tool, the forces on the cutting edges of the trim die 17 are relatively low, but good engagement between such cutting edges and the head of the blank 36 is established, and a slight amount of cutting edge penetration occurs. Because the tool 10, and in turn a blank 36 supported therein, can move with the trim die during the initial portion of the contact with the trim die, high energy impact loading on the cutting edges does not occur.

As soon as the tool 10 reaches its rearwardmost position, and after the initial seating occurring during the sliding movement of the tool, the blank is held against further movement and the continued forward movement of the trim dies toward the forward dead center position illustrated results in shearing away head material to form the desired polygonal shape on the bolt blank. In the illustrated embodiment, such polygonal shape is hexagonal, but the present invention is applicable to other polygonal or nonpolygonal shapes as required.

Figure 3A:
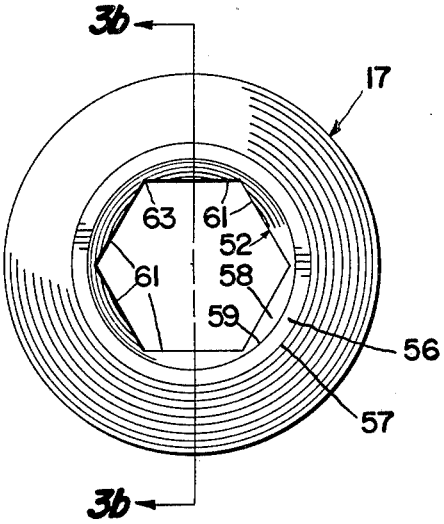
FIG. 3*a* is an enlarged end view of the trim die which is carried by the slide.
Figure 3B:
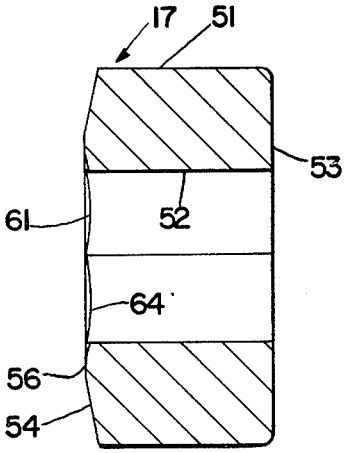
FIG. 3*b* is a side elevation in longitudinal section of the trim die illustrated in FIG. 3*a*.
Figure 3C:
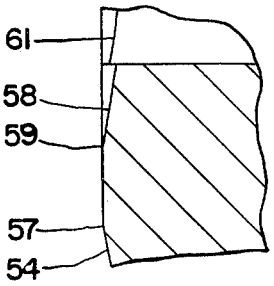
FIG. 3*c* is a further enlarged, fragmentary section of the trim die.
Figure 4:
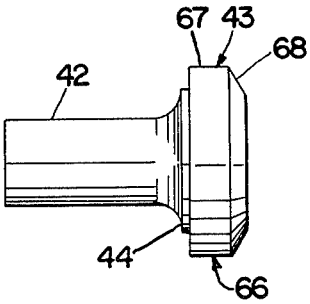
FIG. 4 is a side elevation of a typical headed blank prior to the trimming operation.

Referring now to FIGS 2*a* through 4, the tool 10 is provided with a cylindrical portion 41 extending forward from the flange 26 and a through bore 37 adapted to receive the shank 42 of an untrimmed headed blank 43 illustrated in FIG. 4. In the illustrated embodiment, the blank 43 is formed with a washer face 44 so the end face 38 of the tool 10 is formed with a circular recess 46 to receive and mate with the washer face 44. Radially outward from the recess 46 the tool is formed with a radial end surface 47 which extends from the recess 46 to a conical end surface 48.

Referring now to FIGS. 3*a*, 3*b*, and 3*c*, the trim die 17 provides a cylindrical periphery 51 which fits into the die holder 21 and is clamped by a clamp mechanism (not illustrated) to secure the die in position. The die is provided with a central axial passage 52 of polygonal shape, which, in the illustrated embodiment, is hexagonal. The passage 52 extends from a planar, rearward face 53 to the forward end of the die.

The forward end or forward face of the die is formed with an outer cone face 54 extending inwardly to a circular land 56 and intersects such land along a circular intersection 57, as best illustrated in FIG. 3*c*. The land extends radially to its inner edge, where it intersects an inner cone 58 along a circular line of intersection 59. The cone 58 extends back from the forward extremity of the die provided by the land 56 and intersects the polygonal passage 52 to provided six cutting edges 61 in the case of a hexagonal passage. The six cutting edges 61, which are formed by the intersection of the inner cone 58 and the passage 52, have a slight curvature, as illustrated in FIG. 3*b*, and are spaced back from the plane of the lands 56 a greatest distance at their centers. They extend forwardly toward such plane but do not intersect the plane at the corners 63. This is because the corners 63 are radially spaced inward a slight amount from the line of intersection 59 between the lands 56 and the cone 58. Consequently, the cutting edges 61 are spaced back from the plane of the land 56 a small amount and cannot engage the radial end face 47 of the tool 10 even when the machine is operated without blanks. Consequently, the cutting edges themselves are not damaged by the operation of the machine without blanks, and the opposed surfaces provided by the land 56 and the end surface 47 engage before the cutting edges 61 reach the tool.

Preferably, the inner cone 58 has a relatively small cone angle so that it does not interfere with the flow of material as it is sheared by the cutting edges 61. In the illustrated embodiment, the angle of the cone 58 with respect to the land 58 is 10 degrees, and with respect to the line of movement of the slide forms an angle of 80°. The cone 58 intersects the passageway 52 at the center of the flats therein at a location 64, which is about 0.010 inch back from the plane of the land 56. However, it is preferable that this dimension be sufficiently large to ensure that the cutting edges at the corners 63 are also spaced back from the plane of the land a small amount to ensure that the cutting edges at their corners do not engage the tool.

The outer cone 54 in the illustrated embodiment is angled back from the plane of the land 56 by an angle of about 10 degrees (or 80° with respect to the direction of slide movement), and the cone angle of the cone surface 48 of the tool 10 is preferably in the range of 50 degrees to 75 degrees. The two cones 54 and 48, respectively, on the trim die 17 and tool 10 facilitate the movement of the scrap material trimmed away from the head and should be made with sufficiently large cone angles to prevent significant welding between the cone surfaces and the material being trimmed from the blank. Generally, the angle of the cone 48 may be smaller when producing smaller blanks and is increased to the higher angles within the range when producing larger blanks.

Preferably, the angles are also proportioned so that the scrap material trimmed from the blank does not separate, but remains in a ring which falls away from the trim die station as the slide retracts. A jet of coolant liquid is preferably directed onto the tool and die in a manner to facilitate the movement of the scrap out of the trim station, as well as to provide cooling of the tool and die.

As illustrated in FIG. 4, a typical untrimmed blank is formed with a circular head 66 consisting of a cylindrical portion 67 and a conical portion 68. Normally, the diameter of the circular portion is slightly greater than the distance across corners of the hexagonal passage 56 and the conical portion 68 is formed with a cone angle of 30 degrees. Because the angle of the cone 68 is greater than the angle of the inner cone 58 formed on the trim die 17, the initial engagement between the cutting edges 61 and the blank 43 occurs at the centers of the cutting edges 66. As the shearing commences, the engagement between the cutting edges and the blank head rapidly progresses along the entire length of the cutting edges 61 to the corners 63. The width of the land 56 is preferably relatively small, so that the material being trimmed from the head reaches the cone surface 54 without having to engage a radial surface of any substantial width. Its width, however, must be sufficiently wide so that it does not cut into the face of the tool when the machine is operating without blanks. As mentioned above, the die and the tool should be adjusted so that when they are operating with blanks and shear material from the head, the land 56 does not actually engage the surface 47 even when the slide reaches the forward dead center position but, rather, a small spacing on the order of 0.030 inch remains. The final shearing of the small or thin section remaining when the die reaches the forward dead center position is accomplished by the forward movement of the ejector pin 35, which completes the shearing of the thin section and moves the blank into the passage 23. However, when the machine is operated for any reason without the presence of blanks to maintain the spacing between the tool and die, the land 56 actually engages the surface 47 and engagement of these opposed surfaces prevents engagement of the cutting surfaces with the tool.

In accordance with the preferred embodiment of this invention illustrated, the tool can slide to reduce the initial impact on the cutting edges, and such arrangement, which reduces such impact, tends to reduce wear and improve die life. However, the most significant improvement is achieved by arranging the structure so that the cutting edges do not actually engage the tool when the machine is operating without blanks. Therefore, in accordance with the broader aspects of this invention, the tool can be mounted without provision for such sliding movement.

Although the preferred embodiment of this invention has been shown and described, it should be understood that various modifications and rearrangements of the parts may be resorted to without departing from the scope of the invention as disclosed and claimed herein.

What is claimed is:

1. A machine for producing bolts or the like comprising a frame, a slide on said frame reciprocable along a line of movement between a forward position and a rearward position, a tool on said frame, a trim die on said slide, said tool operating to support a bolt blank having a nonpolygonal head for trimming of said head by said trim die as said slide moves to said forward position, said trim die providing a polygonal shaped opening and polygonal cutting edges at the forward end of said opening facing said tool, said cutting edges engaging said nonpolygonal head as said slide moves to said forward position and cooperating with said tool to shear away material of said nonpolygonal head to produce a polygonal head on said blank, said tool and die providing opposed stop surfaces which engage when said machine is operating without blanks, engagement of said opposed stop surfaces preventing contact between said cutting edges and said tool.

2. A machine as set forth in claim 1, wherein a blank positioned in said tool prevents contact between said opposed surfaces when said machine is operating to shear blanks.

3. A machine as set forth in claim 1, wherein said trim die is formed with a shallow recess extending back from said stop surface thereon, and said cutting edges are located in said recess.

4. A machine as set forth in claim 3, wherein said stop surface of said die is an annular surface extending around said recess.

5. A machine as set forth in claim 4, wherein said trim die is formed with a receding surface extending around said stop surface thereon.

6. A machine as set forth in claim 5, wherein said recess is provided by a shallow conical surface.

7. A machine as set forth in claim 6, wherein said receding surface is conical.

8. A machine as set forth in claim 7, wherein both of said conical surfaces intersect the line of movement of said slide at an angle of about 80 degrees.

9. A machine as set forth in claim 8, wherein the forward end of said tool is formed with a rearwardly extending cone surface extending around said stop surface theron and forming an angle therewith between about 50 degrees and 75 degrees.

10. A machine as set forth in claim 9, wherein said tool is mounted on said frame for limited reciprocating movement toward and away from said slide and is biased toward said slide to reduce the impact loading on said cutting edges when they first engage a blank supported by said tool.

11. A machine as set forth in claim 3, wherein said recess is a shallow cone intersecting said stop surface thereof at an angle of about 10 degrees.

12. A machine as set forth in claim 1, wherein said tool is mounted on said frame for limited reciprocating movement toward and away from said slide and is biased toward said slide to reduce the impact loading on said cutting edges when they first engage a blank supported by said tool.

13. A tool and die for trimming bolt heads or the like comprising a tool to support a headed bolt blank with the head exposed, a trim die formed with a cutting edge operable to engage the exposed head of a blank supported by said tool and to shear away head material to form a head with a desired shape as said tool and die move toward each other to a final position, said tool and die being formed with opposed stop surfaces which engage when said tool and die reach said final position without a blank supported by said tool, engagement of said opposed stop surfaces preventing contact between said cutting edge and said tool.

14. A tool and die as set forth in claim 13, wherein said die is formed with a shallow recess extending radially inward from the stop surface thereon and said cutting edge is located in said recess .

15. A tool and die as set forth in claim 14, wherein said recess is a shallow cone having an angle with respect to the stop surface of said die of about 10 degrees.

16. A tool and die as set forth in claim 15, wherein said cutting edge is polygonal and operates to form a polygonal head on a blank.

17. A tool and die as set forth in claim 16, wherein said die is formed with a receding end face extending around said stop surface thereon.

18. A tool and die as set forth in claim 17, wherein said tool is formed with a receding cone surface extending around said stop surface thereon.

19. In tooling for cutting a polygonal head on a blank, including a tool and a die, the improvement comprising a die body formed with a polygonal passage therethrough extending from a forward face to a rearward face, said forward face being formed with an annular land extending around its face from said passage, a recess within said land intersecting the forward end of said passage and providing cutting edges at such intersection, said cutting edges being spaced back from said land, said land being operable to engage a surface on said tool to prevent contact between said cutting edges and said tool even when a blank is not supported in said tool.

20. A trim die as set forth in claim 19, wherein said recess is a shallow cone forming an angle with respect to said land of about 10 degrees.

21. A trim die as set forth in claim 20, wherein said trim die is provided with a receding surface extending around said land.

22. A trim die as set forth in claim 21, wherein said receding surface is a cone.

23. A trim die as set forth in claim 19, wherein said forward end thereof is formed with a receding surface around said land.

* * * * *